US007107953B2

(12) United States Patent
Takayasu et al.

(10) Patent No.: US 7,107,953 B2
(45) Date of Patent: Sep. 19, 2006

(54) VALVE GEAR OF AN INTERNAL COMBUSTION ENGINE

(75) Inventors: Norio Takayasu, Kyoto (JP); Toshihiko Oka, Anjyo (JP); Tetsushi Nagira, Toyota (JP); Satoshi Ando, Aichi (JP); Shinichi Murata, Okazaki (JP); Masanori Tokuhisa, Rittou (JP)

(73) Assignees: Mitsubishi Jidosha Kogyo Kabushiki Kaisha, Tokyo (JP); Mitsubishi Jidosha Engineering Kabushiki Kaisha, Aichi (JP)

( * ) Notice: Subject to any disclaimer, the term of this patent is extended or adjusted under 35 U.S.C. 154(b) by 111 days.

(21) Appl. No.: 10/941,956

(22) Filed: Sep. 16, 2004

(65) Prior Publication Data

US 2005/0092270 A1 May 5, 2005

(30) Foreign Application Priority Data

Sep. 18, 2003 (JP) ..... 2003-326793
Sep. 18, 2003 (JP) ..... 2003-326794

(51) Int. Cl.
*F01L 1/18* (2006.01)

(52) U.S. Cl. ..... 123/90.39; 123/90.44; 74/569

(58) Field of Classification Search ..... 123/90.39, 123/90.44, 90.6; 74/559, 567, 569; 29/888.2
See application file for complete search history.

(56) References Cited

U.S. PATENT DOCUMENTS 6,644,254 B1 * 11/2003 Harada et al. ..... 123/90.16
7,007,646 B1 * 3/2006 Takayasu et al. ..... 123/90.16

FOREIGN PATENT DOCUMENTS

JP 2001-041017 A 2/2001

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

A valve gear for an internal combustion engine capable of promptly switching the position of a piston in a rocker arm to thereby change the engine operating condition with a satisfactory response, even in a low rotation region in which an adequate amount of oil discharged from an oil pump cannot be expected. Depending on positions of pistons slidably fitted in low-speed and high-speed cylinder portions provided in an intake driven rocker arm, a low-speed or high-speed drive rocker arm is selectively operated to press a corresponding one of the pistons. The piston in the low-speed cylinder portion switched in a low rotation region is made smaller in diameter than the piston in the high-speed cylinder portion, to be enabled to be promptly switched.

13 Claims, 11 Drawing Sheets

VALVE GEAR OF AN INTERNAL COMBUSTION ENGINE

CROSS-REFERENCE TO RELATED APPLICATIONS

This Nonprovisional application claims priority under 35 U.S.C. § 119(a) on Patent Application Nos. 2003-326793 and 2003-326794 both filed in Japan on Sep. 18, 2003, the entire contents of which are hereby incorporated by reference.

BACKGROUND OF THE INVENTION

1. Field of the Invention

The present invention relates to a valve gear of an internal combustion engine (hereinafter referred to as engine).

2. Description of the Related Art

To realize engine-output characteristics optimum for operating regions, there have been proposed a variety of engines adapted to switch valve-opening periods and lift amounts of intake and exhaust valves, etc. (refer to Japanese provisional patent publication no. 2001-41017, for example).

The engine disclosed in this publication is provided with a driven rocker arm supported by a rocker shaft so as to be rocked by a first cam for low speed to thereby drive the intake valve to open and close, and a drive rocker arm supported by the rocker shaft at a location adjacent to the driven rocker arm so as to be rocked by a second cam for high speed. The driven rocker arm is formed with a cylinder in which a piston is accommodated for sliding motion when supplied with oil pressure, and the drive rocker arm is formed with an engaging projection adapted to be engaged with the piston when the drive rocker arm is rocked.

In a low rotation region of the engine for example, the piston of the driven rocker arm is switched to a lower position where the engaging projection of the drive rocker arm runs at idle, so that the intake valve is driven to open and close by the driven rocker arm along the shape of the first cam. In a high rotation region of the engine, on the other hand, the piston of the driven rocker arm is switched to an upper position where the engaging projection of the drive rocker arm acts to press the piston, so that the driven rocker arm is rocked in conjunction with the drive rocker arm, whereby the intake valve is driven to open and close along the shape of the second cam.

As described above, the engine disclosed in Japanese provisional patent publication No. 2001-41017 is designed to make the switching between the two operating conditions in each of which the intake valve is driven to open and close by a corresponding one of the first and second cams. There is the demand such as for example that the engine of this type be provided with not only the just-mentioned function but also a cylinder suspending function of suspending the operation of a particular cylinder.

To meet such demand, it is considered that a further drive rocker arm may be provided so as to be rocked by the first cam as in the case of the drive rocker arm associated with the second cam, and a pair of pistons may be provided in the driven rocker arm to be slidable for engagement with engaging projections of these drive rocker arms. In such valve gear, depending on the sliding positions of the pistons, the driven rocker arm is rocked in conjunction with either one of the drive rocker arms to thereby drive the intake valve to open and close according to the shape of a corresponding one of the cams. When the pistons assume their sliding positions where the engaging projections of the drive rocker arms run at idle, the driven rocker arm maintains the intake valve closed, whereby a cylinder suspending operation is performed.

To be noted, the switching of the piston position in the driven rocker arm is made utilizing oil that is discharged from a lubricant oil pump of the engine. In a low rotation region of the engine, the rotation speed of the oil pump is low and hence an adequate amount of discharge cannot be expected. For this reason, in a low rotation region where the piston position is switched in the driven rocker arm on the side of the first low-speed cam, the piston's sliding motion is slow in speed. This poses a problem that the engine operating condition cannot be switched promptly.

Meanwhile, an upper portion of the piston of the driven rocker arm, which, when pressed by the engaging projection of the drive rocker arm, causes the entire driven rocker arm to be rocked against the inertial mass, is required to have a higher rigidity as compared to the lower portion of the piston that mainly receives an oil pressure alone. In this regard, the engine disclosed in Japanese provisional patent publication No. 2001-41017 has a piston that is made in its entirety of a material that satisfies the characteristic required for the upper portion of the piston. As a result, each individual piston becomes inevitably high in fabrication cost, which affects the fabrication cost of the entire valve gear requiring the provision of the piston for every drive rocker arm of each cylinder.

SUMMARY OF THE INVENTION

An object of the present invention is to provide a valve gear of an internal combustion engine, which is capable of promptly switching the position of a piston in a rocker arm to thereby change the engine operating condition with a satisfactory response, even in a low rotation region in which an adequate amount of discharge from an oil pump cannot be expected.

According to one aspect of this invention, there is provided a valve gear with a cylinder suspending mechanism of an internal combustion engine, which comprises: a first rocker arm having a tip end connected to either one of an intake valve and an exhaust valve and pivotably supported on a first rocker shaft; a second rocker arm located at one side of the first rocker arm, pivotably supported on the first rocker shaft, and driven by a first cam for low speed; a third rocker arm located at the other side of the first rocker arm, pivotably supported on the first rocker shaft, and driven by a second cam for high speed; a first piston slidably fitted into a first cylinder formed in the first rocker arm; a second piston slidably fitted into a second cylinder formed in the first rocker arm; a first engaging projection extending from the second rocker arm and formed to be engageable with the first piston; a second engaging projection extending from the third rocker arm and formed to be engageable with the second piston; first and second switching mechanisms for applying oil pressure to the first and second pistons, to thereby switch these pistons between an engaging position and a non-engaging position with respect to the first and second engaging projections, respectively; and control means for controlling the switching of the first and second switching mechanisms, wherein the first piston is made smaller in diameter than the second piston.

According to another aspect of this invention, there is provided a valve gear with a cylinder suspending mechanism of an internal combustion engine, which comprises: a first rocker arm having a tip end connected to either one of an intake valve and an exhaust valve and pivotably supported on a first rocker shaft; a second rocker arm located at one side of the first rocker arm, pivotably supported on the first rocker shaft, and driven by a first cam for low speed; a third rocker arm located at the other side of the first rocker arm, pivotably supported on the first rocker shaft, and driven by a second cam for high speed; a fourth rocker arm having a tip end connected to the other one of the intake valve and the exhaust valve and pivotably supported on a second rocker shaft that is disposed in parallel to the first rocker shaft; a fifth rocker arm pivotably supported on the second rocker shaft and driven by a third cam; a first piston slidably fitted into a first cylinder formed in the first rocker arm; a second piston slidably fitted into a second cylinder formed in the first rocker arm; a third piston slidably fitted into a third cylinder formed in the fourth rocker arm; a first engaging projection extending from the second rocker arm and formed to be engageable with the first piston; a second engaging projection extending from the third rocker arm and formed to be engageable with the second piston; a third engaging projection extending from the fifth rocker arm and formed to be engageable with the third piston; first, second, and third switching mechanisms for applying oil pressure to the first, second, and third pistons, to thereby switch these pistons between an engaging position and a non-engaging position with respect to the first, second, and third engaging projections, respectively; and control means for controlling the switching of the first, second, and third switching mechanisms, wherein each of the first and third pistons is made smaller in diameter than the second piston.

According to a further aspect of this invention, there is provided a valve gear of an internal combustion engine, which comprises: a sixth rocker arm having a tip end connected to either one of an intake valve and an exhaust valve, pivotably supported on a rocker shaft, and driven by a fourth cam; a seventh rocker arm located adjacent to the sixth rocker arm, pivotably supported on the rocker shaft, and driven by a fifth cam having a cam shape different from that of the fourth cam; a fourth piston slidably fitted into a fourth cylinder formed in either one of the sixth and seventh rocker arms; a fourth engaging projection extending from the other of the sixth and seventh rocker arms and formed to be engageable with the fourth piston; fourth switching mechanisms for switching the fourth piston between an engaging position and a non-engaging position with respect to the fourth engaging projection; and control means for controlling the switching of the fourth switching mechanism, wherein the fourth piston is vertically divided into two, one is a first portion adapted to be engaged with the fourth engaging projection and the other is a second portion adapted not to be engaged with the fourth engaging projection.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

A valve gear with a cylinder suspending mechanism of an engine according to a first embodiment of the present invention will be described below.

The engine according to the present embodiment is constructed as a V-six cylinder gasoline engine having four valves per cylinder, and is designed to be capable of switching a high-speed mode for realizing particularly high engine output, a low-speed mode for dealing with normal engine output, and a cylinder suspending mode for suspending cylinders located on one of two banks. To this end, valve gears of both banks each have a switching mechanism for switching the low-speed mode and the high-speed mode, and one of the banks is provided with a cylinder suspending mechanism. First of all, an explanation will be provided about a configuration of the bank having the cylinder suspending mechanism (hereinafter referred to as a suspension cylinder bank, and the opposite one as a non-suspension cylinder bank).

<Suspension Cylinder Bank>

Figure 1:
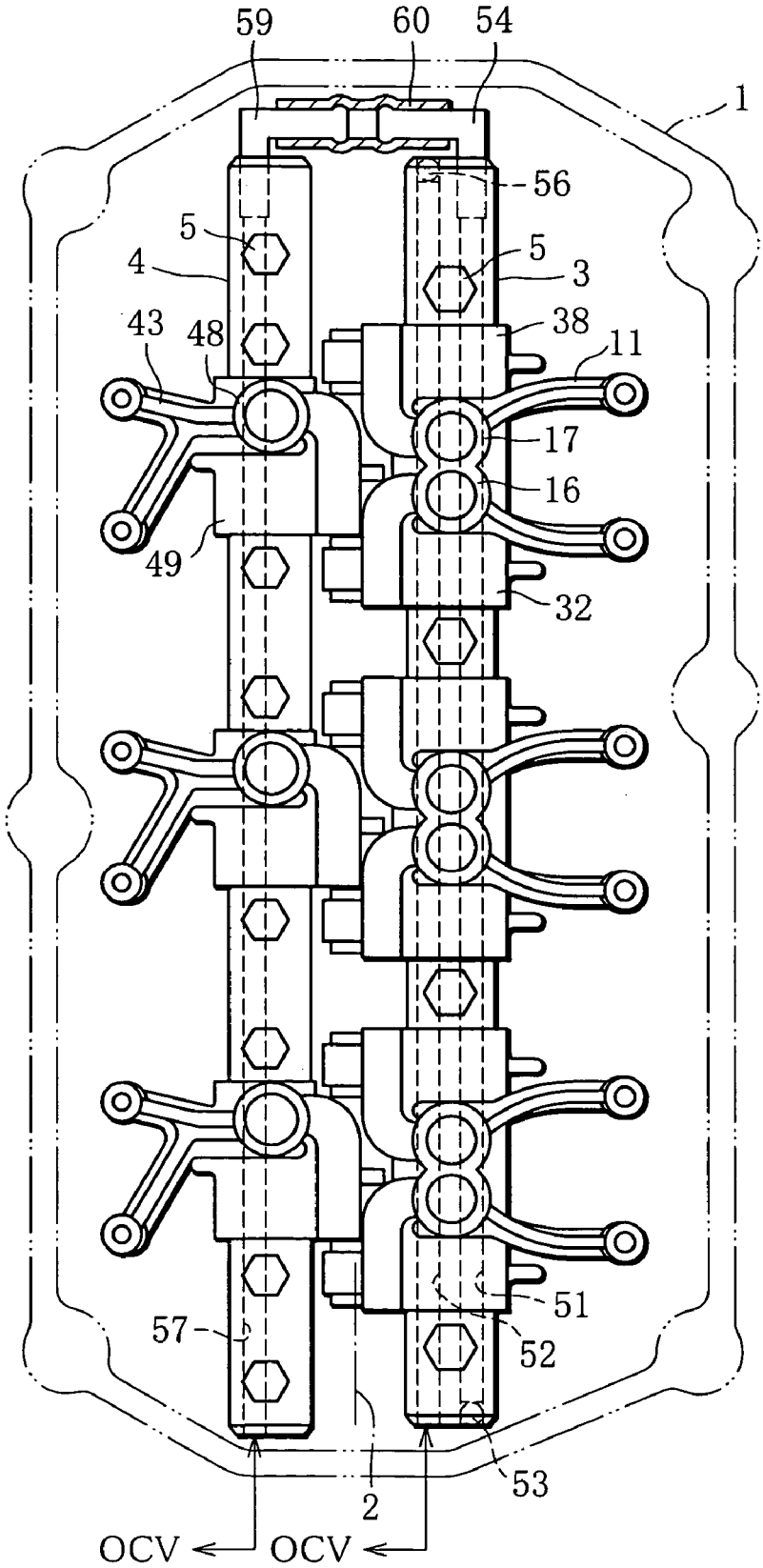
FIG. 1 is a plan view showing a cylinder head of an engine having a valve gear according to a first embodiment of this invention.

FIGS. 1 through 8 show a cylinder head of the suspension cylinder bank. It is assumed here that the upper and lower direction in FIG. 1 represents the longitudinal direction of the engine, the right side of the cylinder head is an intake side, and the left side is an exhaust side. There is disposed a cylinder head of the non-suspension cylinder bank on the right of the cylinder head of the suspension cylinder bank.

Figure 2:
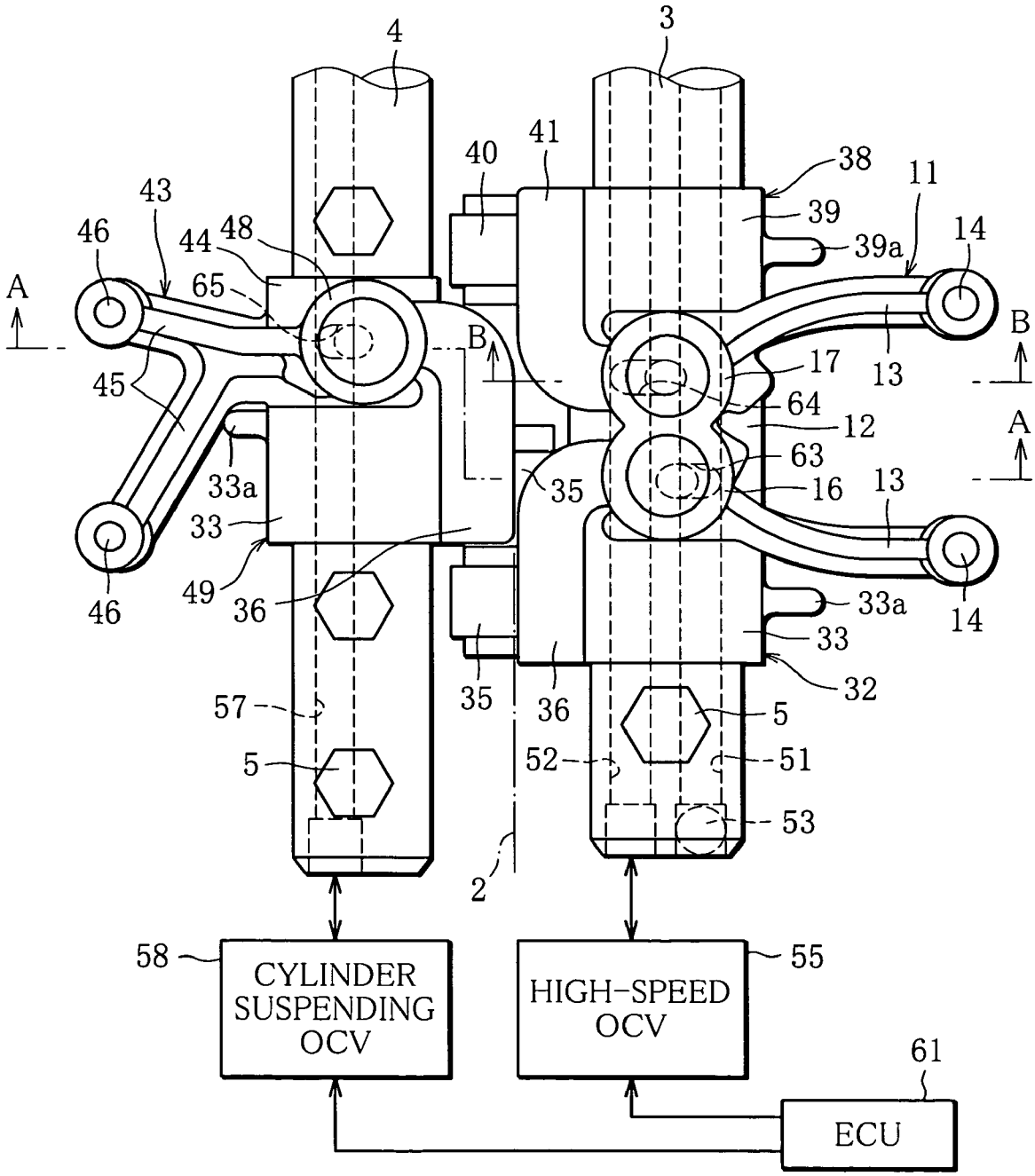
FIG. 2 is an enlarged partial plan view showing details of the valve gear for one cylinder.
Figure 3:
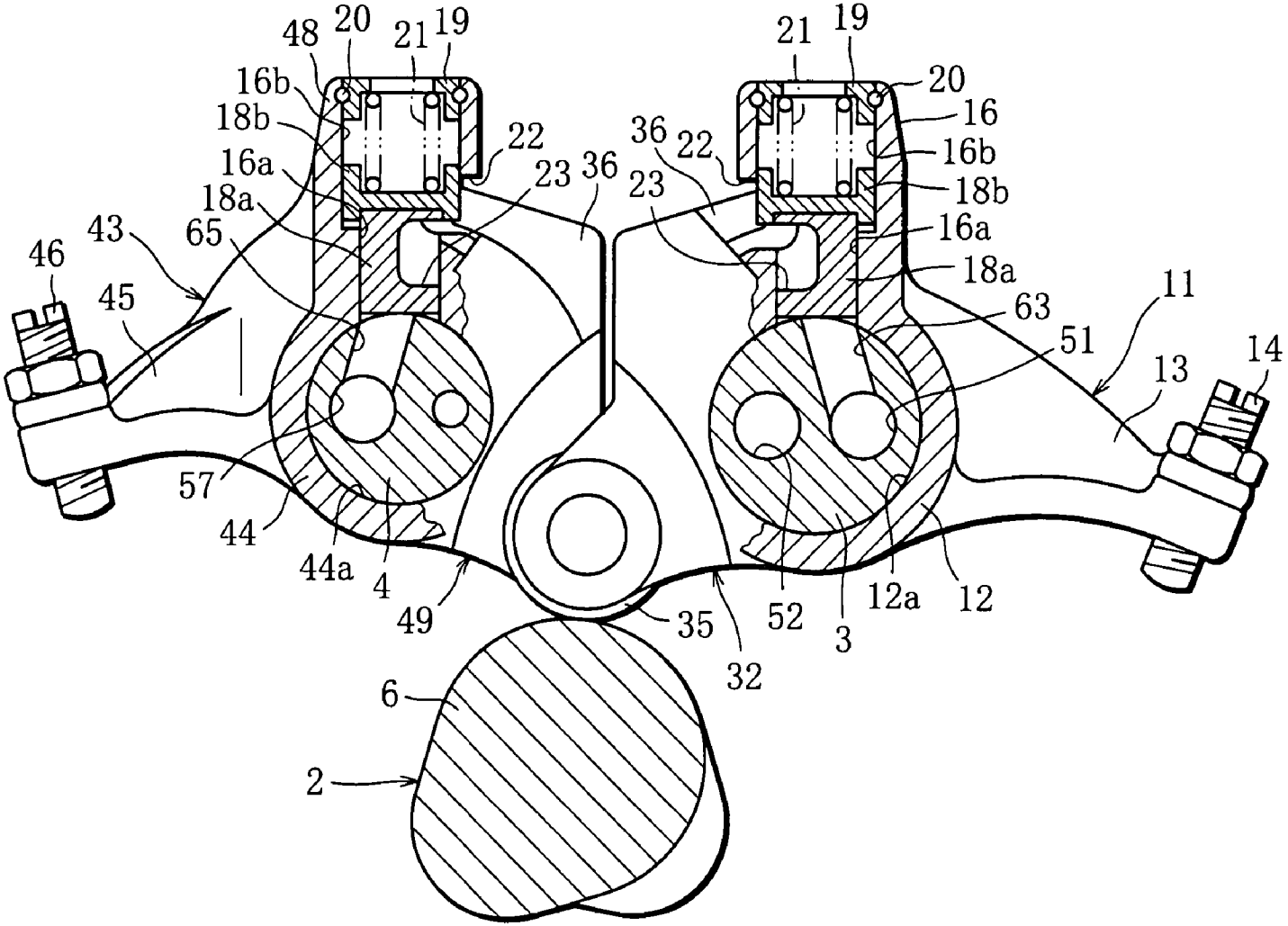
FIG. 3 is a cross-sectional view taken along line A—A of FIG. 2, showing an operating state of a low-speed cam and an exhaust cam.
Figure 7:
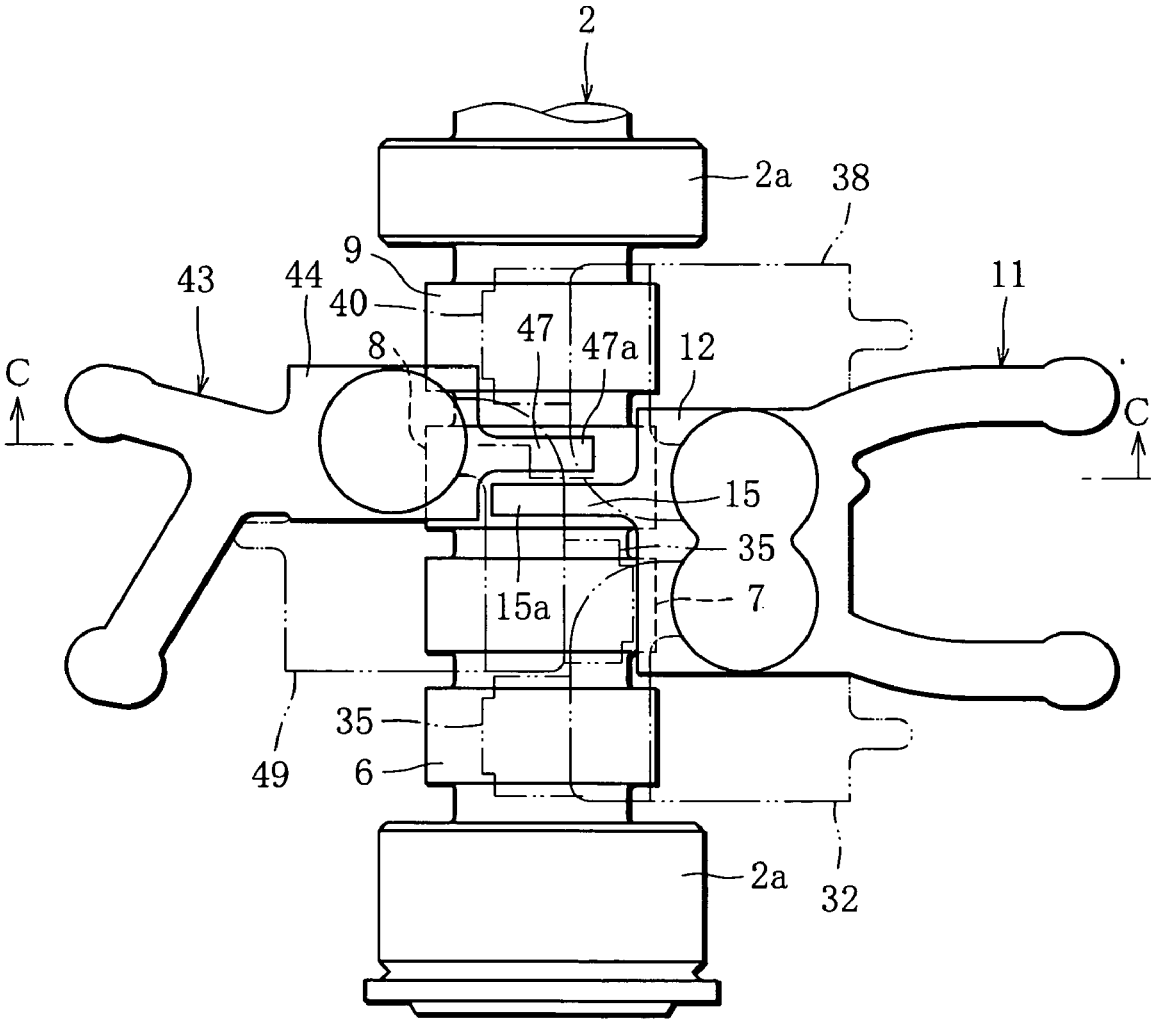
FIG. 7 is an enlarged partial plan view showing the positional relation of drive rocker arms and driven rocker arms with respect to the cams.

As illustrated in FIGS. 2, 3 and 7, a camshaft 2 of the valve gear is disposed in the substantial middle of a cylinder head 1 to extend in a longitudinal direction. The camshaft 2 has journal portions 2*a* supported by respective cylinder head journals, not shown, to be driven by a crankshaft to rotate in synchronization. An intake rocker shaft 3 (first rocker shaft) is arranged on the upper right side of the camshaft 2, and an exhaust rocker shaft 4 (second rocker shaft) on the upper left side of the camshaft 2. The rocker shafts 3 and 4 are appropriately fixed onto the cylinder head 1 with bolts 5 in parallel with the camshaft 2.

Cylinders are arranged in a row along the camshaft 2 in the longitudinal direction. The valve gear for one of the cylinders will be described below, and it should be noted that the valve gears for the other cylinders each have the identical configuration. As shown in FIG. 7, formed in between two adjacent journal portions 2*a* of the camshaft 2 are cams for one cylinder, including a low-speed-side intake cam 6 (first cam, and hereinafter abbreviated as low-speed cam), an exhaust cam 7 (third cam), a suspension cam 8, and a high-speed-side intake cam 9 (second cam, and hereinafter abbreviated as high-speed cam) arranged in the order named from the front side. Configurations of intake-side and exhaust-side valve gears driven by the cams 6 through 9 and configurations of oil paths for switching the valve gears will be described below in due order.

<Intake-Side Valve Gear>

As illustrated in FIGS. 2 and 3, the intake rocker shaft 3 is fitted in a bearing bore 12*a* formed in a boss portion 12 of an intake driven rocker arm 11 (first rocker arm), and the entire intake driven rocker arm 11 can be oscillated around the intake rocker shaft 3. Two valve-side arm portions 13 formed into a biforked shape extend from the boss portion 12 in a rightward direction. Provided to a tip end of each valve-side arm portion 13 is an adjust bolt 14 for valve clearance adjustment, which corresponds to an intake valve, not shown, located on the cylinder head 1.

Figure 8:
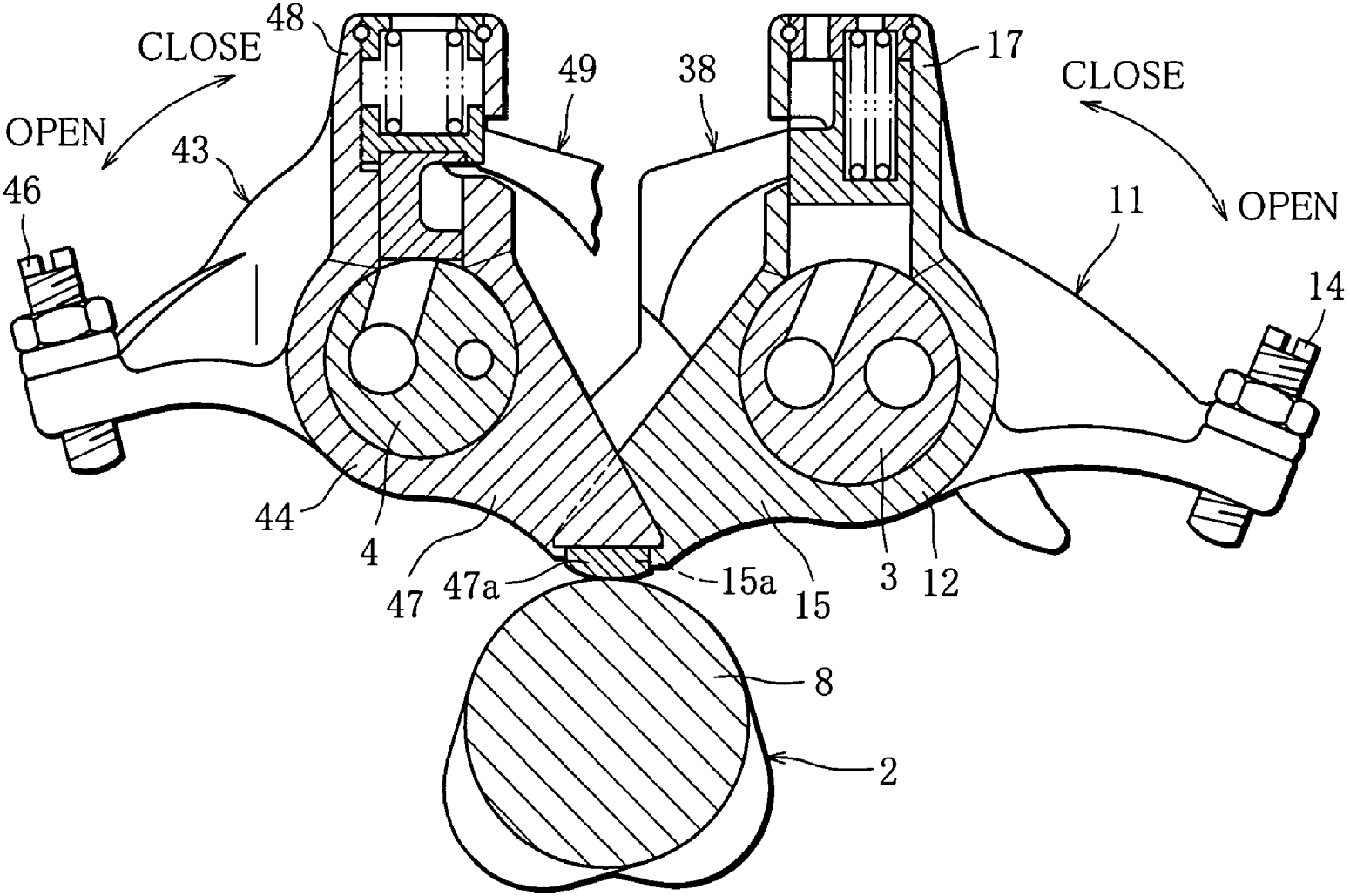
FIG. 8 is a cross-sectional view taken along line C—C of FIG. 7.

Referring to FIGS. 7 and 8, a cam-side arm portion 15 extends from the boss portion 12 in a leftward direction, and a sliding-contact portion 15*a* formed in a tip end of the cam-side arm portion 15 is in contact with the suspension cam 8. If the intake driven rocker arm 11 is oscillated clockwise while the sliding-contact portion 15*a* of the cam-side arm portion 15 is in contact with the suspension cam 8, the intake valves are opened against valve springs through the adjust bolts 14 of the valve-side arm portions 13. Hereinafter, an oscillating direction of members constructing the intake-side valve gear, including the intake driven rocker arm 11, an after-mentioned low-speed drive rocker arm 32, an after-mentioned high-speed drive rocker arm 38 and the like, is defined as a valve-opening direction if the oscillating direction is clockwise, and a valve-closing direction if counterclockwise.

Figure 5:
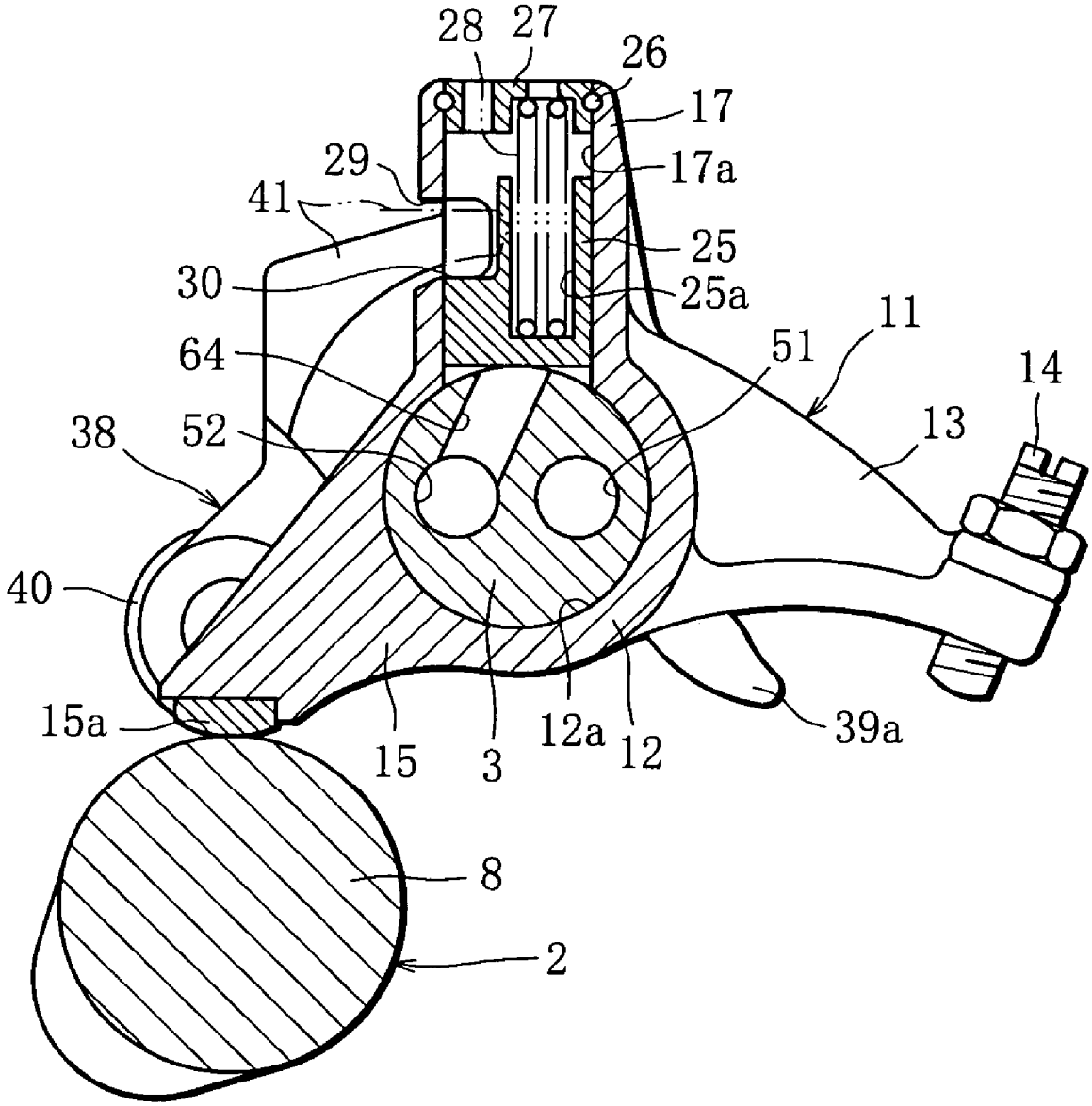
FIG. 5 is a cross-sectional view taken along line B—B of FIG. 2, showing a suspending state of a high-speed cam.

As illustrated in FIGS. 2, 3 and 5, on the boss portion 12 of the intake driven rocker arm 11, a cylindrical low-speed cylinder portion 16 and a cylindrical high-speed cylinder portion 17 are integrally formed alongside. Formed in the low-speed cylinder portion 16 is a lower cylinder 16*a* (one half of a first cylinder) with a small diameter and an upper cylinder 16*b* (another half of the first cylinder) with a large diameter, each having a circular shape in section. The lower cylinder 16*a* and the corresponding upper cylinder 16*b* are formed continuously in a vertical direction. The lower cylinder 16*a* has a lower end that is open in an inner circumferential surface of the bearing bore 12*a* of the boss portion 12, and the upper cylinder 16*b* has an upper end that is open upward.

Disposed in the lower cylinder 16*a* is a lower piston 18*a* (a second portion of a first piston). The lower piston 18*a* can slide in the lower cylinder 16*a* in the vertical direction while being restricted in rotation around the axis of the lower cylinder 16*a* by a restriction pin, not shown. In the upper cylinder 16*b*, there is located an upper piston 18*b* (a first portion of the first piston), which is also slidable in the upper cylinder 16*b* in the vertical direction. The upper piston 18*b* is made of a material having higher rigidity than a material used for making the lower piston 18*a*.

Figure 4:
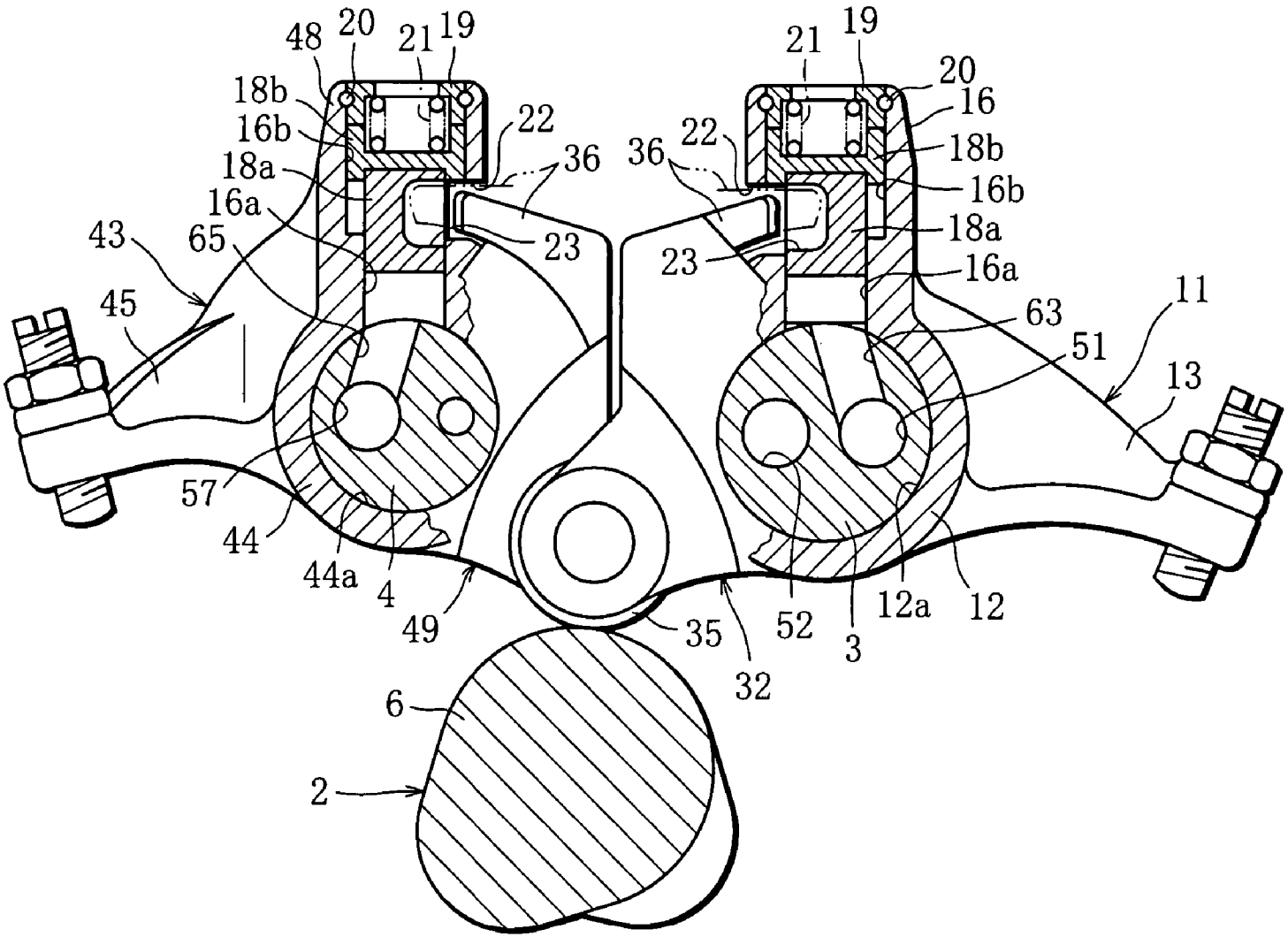
FIG. 4 is a cross-sectional view taken along line A—A of FIG. 2, showing a suspending state of the low-speed cam and the exhaust cam.

A cap 19 is pressed into an opening of the upper cylinder 16*b* and prevented by a snap ring 20 from being detached therefrom. In the upper cylinder 16*b*, there is interposed a compression spring 21 between the cap 19 and the upper piston 18*b*. As shown in FIG. 3, the lower piston 18*a* and the upper piston 18*b* are downwardly biased by the compression spring 21 all the time, thereby being held in respective lower positions which bring a lower surface of the lower piston 18*a* into contact with an outer circumferential surface of the intake rocker shaft 3. As illustrated in FIG. 4, when the lower piston 18*a* and the upper piston 18*b* slide upward from the lower positions in the cylinders 16*a* and 16*b*, resisting the compression spring 21, an upper portion of the upper piston 18*b* is brought into contact with a lower portion of the cap 19. Accordingly, the lower piston 18*a* and the upper piston 18*b* are switched to respective upper positions.

An operation window 22 is formed in a left surface of the low-speed cylinder portion 16, that is, in a side facing the camshaft 2, and a run-off 23 is formed as a recess in a left surface of the lower piston 18*a*. When the pistons 18*a* and 18*b* are in the upper positions shown in FIG. 4, the run-off 23 of the lower piston 18*a* is exposed leftward through the operation window 22. In the lower positions shown in FIG. 3, an outer circumferential surface of the upper piston 18*b* is exposed leftward through the operation window 22.

Referring to FIG. 5, a cylinder 17*a* (second cylinder) having a circular shape in section is formed in the high-speed cylinder portion 17 in the vertical direction. The cylinder 17*a* has a lower end that is open in the inner circumferential surface of the bearing bore 12*a* of the boss portion 12 and an upper end that is open upward. Fitted in the cylinder 17*a* is a piston 25 (second piston). The piston 25 can slide in the cylinder 17*a* in the vertical direction while being restricted in rotation around the axis of the cylinder 17*a* by a restriction pin, not shown. The piston 25 has the diameter larger than the diameter of the lower piston 18*a* in the low-speed cylinder portion 16 and substantially the same as the diameter of the upper piston 18*b*. The piston 25 is made of the same material as one used for making the upper piston 18*b* of the low-speed cylinder portion 16, to thereby secure equivalent rigidity.

Figure 6:
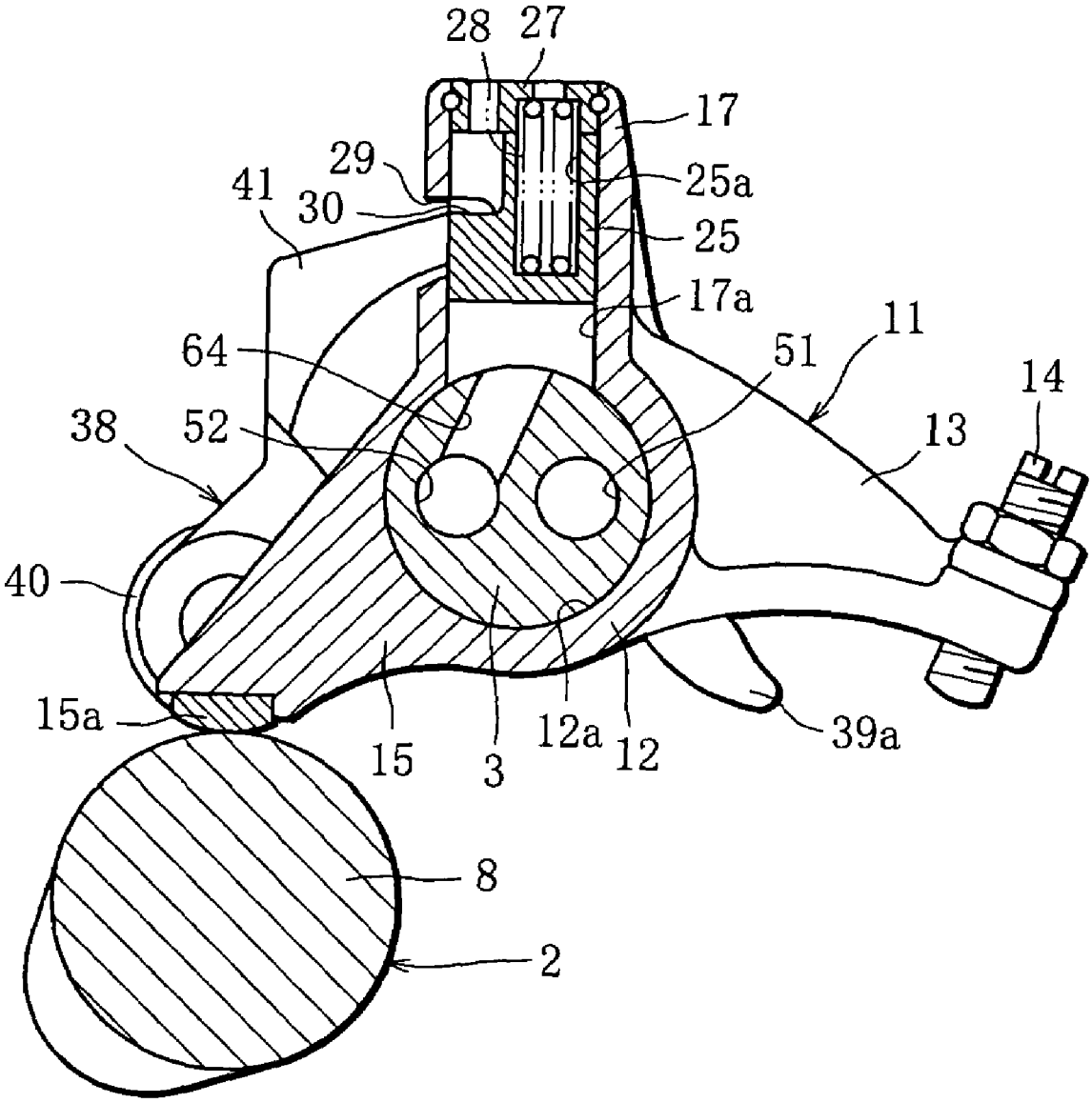
FIG. 6 is a cross-sectional view taken along line B—B of FIG. 2, showing an operating state of the high-speed cam.

As is the case with the low-speed cylinder portion 16, a cap 27 is fitted in an opening of the cylinder 17*a* with a snap ring 26, and a compression spring 28 is interposed between the cap 27 and the piston 25. As illustrated in FIG. 5, the piston 25 is constantly biased in the downward direction by the compression spring 28 and maintained in a lower position which brings a lower surface thereof into contact with the outer circumferential surface of the intake rocker shaft 3. Referring to FIG. 6, when the piston 25 upwardly slides from the lower position in the cylinder 17*a*, resisting the compression spring 28, an upper portion of the piston 25 is brought into contact with a lower portion of the cap 27, which switches the piston 25 to an upper position.

There is formed an operation window 29 in a left surface of the high-speed cylinder portion 17, and also a run-off 30 as a recess in a left surface of the piston 25. When the piston 25 is located in the lower position shown in FIG. 5, the run-off 30 of the piston 25 is exposed leftward through the operation window 29. When the piston 25 is placed in the upper position shown in FIG. 6, an outer circumferential surface of the piston 25 is exposed through the operation window 29. The compression spring 28 of the high-speed cylinder portion 17 has a smaller diameter but a greater length than the compression spring 21 of the low-speed cylinder portion 16, to thereby secure a prescribed biasing force applied to the piston 25. Moreover, the compression spring 28 is located offset with respect to the axis of the high-speed cylinder portion 17 and held in a spring hole 25*a* that is formed in the piston 25 to prevent from being bent by compression.

As illustrated in FIGS. 2 and 3, a boss portion 33 of the low-speed drive rocker arm 32 (second rocker arm) is located in front of the intake driven rocker arm 11 on the intake rocker shaft 3 and pivotably supported on the intake rocker shaft 3. In the right side of the boss portion 33, there is a bias portion 33*a* protruding downward. The entire low-speed drive rocker arm 32 is biased in a valve-closing direction by a bias spring, not shown, coupled with the bias portion 33*a*. Accordingly, a roller 35 disposed in the left side is brought into contact with the low-speed cam 6 as shown in FIG. 7.

An operation arm portion 36 (first engaging projection) extends from an upper-side position of the roller 35 of the low-speed drive rocker arm 32 in a rearward direction along the axis of the camshaft 2. The operation arm portion 36 has a tip end that is bent into an L-shape toward the intake driven rocker arm 11 located in the right side thereof, to thereby face the operation window 22 of the low-speed cylinder portion 16. The low-speed drive rocker arm 32 is oscillated along the shape of the low-speed cam 6 while rotating the roller 35 on the low-speed cam 6 that is in rotation. In a base circular zone (zone in which a lift amount is 0) of the low-speed cam 6, the low-speed drive rocker arm 32 is oscillated in the valve-closing direction to separate the tip end of the operation arm portion 36 from the operation window 22 in the leftward direction as shown by a solid line in FIG. 4. In a lift zone of the low-speed cam 6, on the contrary, the low-speed drive rocker arm 32 is oscillated in a valve-opening direction to insert the tip end of the operation arm portion 36 into the operation window 22 as shown by a chain double-dashed line in FIG. 4.

There is formed a boss portion 39 in the high-speed drive rocker arm 38 (third rocker arm), the boss portion 39 being located at the rear of the intake driven rocker arm 11 on the intake rocker shaft 3 and pivotably supported on the intake rocker shaft 3. As is the case with the low-speed drive rocker arm 32, the high-speed drive rocker arm 38 is biased by a bias spring, not shown, in the valve-closing direction through a bias portion 39*a*, to thereby bring a roller 40, which is provided in the left side, into contact with the high-speed cam 9 as illustrated in FIG. 7.

An operation arm portion 41 (second engaging projection) extends from an upper-side position of the roller 40 of the high-speed drive rocker arm 38 in a frontward direction along the axis of the camshaft 2. The operation arm portion 41 has a tip end that is bent into an L-shape toward the intake driven rocker arm 11 located in the right side thereof, to thereby face the operation window 29 of the high-speed cylinder portion 17. Like the low-speed drive rocker arm 32, the high-speed drive rocker arm 38 is oscillated along a shape of the high-speed cam 9 while rotating the roller 40 on the high-speed cam 9. In a base circular zone of the high-speed cam 9, the high-speed drive rocker arm 38 is oscillated in the valve-closing direction to separate the tip end of the operation arm portion 41 from the operation window 29 in the leftward direction as shown by a solid line in FIG. 5. In a lift zone of the high-speed cam 9, on the contrary, the high-speed drive rocker arm 38 is oscillated in the valve-opening direction to insert the tip end of the operation arm portion 41 into the operation window 29 as shown by a chain double-dashed line in FIG. 5.

<Exhaust-Side Valve Gear>

Contrary to the intake-side valve gear, the exhaust-side valve gear does not include the high-speed cylinder portion 17 of the intake driven rocker arm 11 and the high-speed drive rocker arm 38 corresponding thereto. A configuration of the exhaust-side valve gear will be described below.

As illustrated in FIGS. 2 and 3, the exhaust rocker shaft 4 is fitted in a bearing bore 44*a* of a boss portion 44 of an exhaust driven rocker arm 43 (fourth rocker arm). The entire exhaust driven rocker arm 43 can be oscillated around the exhaust rocker shaft 4. Extending leftward from the boss portion 44 are two valve-side arm portions 45 formed into a biforked shape. Each valve-side arm portion 45 has a tip end provided with an adjust bolt 46 corresponding to an exhaust valve, not shown, attached onto the cylinder head 1.

Referring to FIG. 7, the boss portion 12 of the intake driven rocker arm 11 and the boss portion 44 of the exhaust driven rocker arm 43 are arranged in the right and left sides of the camshaft 2, respectively. In addition, the boss portions 12 and 44 partly overlap each other in an axial direction of the camshaft 2. As shown in FIGS. 7 and 8, a cam-side arm portion 47 extends from the boss portion 44 in the rightward direction. Formed in a tip end of the cam-side arm portion 47 is a sliding-contact portion 47*a*, which is in contact with the suspension cam 8 while avoiding interference with the sliding-contact portion 15*a* of the intake driven rocker arm 11.

In the above-described state, if the exhaust driven rocker arm 43 is oscillated counterclockwise, the exhaust valves are opened against the valve springs through the adjust bolts 46 of the valve-side arm portions 45. Hereinafter, an oscillating direction of members constructing the exhaust-side valve gear, including the exhaust driven rocker arm 43, an after-mentioned exhaust drive rocker arm 49 and the like, is defined as a valve-opening direction if the oscillating direction is counterclockwise, and a valve-closing direction if clockwise.

As illustrated in FIGS. 2 and 3, an annular cylinder portion 48 is integrally formed on the boss portion 44 of the exhaust driven rocker arm 43. The cylinder portion 48 has a configuration symmetrical to the low-speed cylinder portion 16 of the intake driven rocker arm 11 as shown in FIG. 3.

The cylinder portion 48 will be roughly described below with the same reference numerals as those for the low-speed cylinder portion 16. The lower piston 18*a* (a second portion of a third piston) and the upper piston 18*b* (a first portion of the third piston) are fitted in the lower cylinder 16*a* (one half of a third cylinder) and the upper cylinder 16*b* (another half of the third cylinder) of the cylinder portion 48, respectively, to be slidable in the vertical direction. These pistons 18*a* and 18*b* are downwardly biased by the compression spring 21. When the pistons 18*a* and 18*b* are in the lower positions as shown in FIG. 3, the lower surface of the lower piston 18*a* is brought into contact with the outer circumferential surface of the exhaust rocker shaft 4, and at the same time, the outer circumferential surface of the upper piston 18*b* is exposed from the operation window 22 of the cylinder portion 48 in the rightward direction. If the pistons 18*a* and 18*b* are in the upper positions as shown in FIG. 4, the run-off 23 of the upper piston 18*a* is exposed from the operation window 22 in the rightward direction.

The members including the lower piston 18*a*, the upper piston 18*b*, the cap 19, the compression spring 21 and the like are commonly used to be accommodated in the exhaust-side cylinder portion 48 and in the intake-side low-speed cylinder portion 16.

As illustrated in FIGS. 2 and 3, the exhaust drive rocker arm 49 (fifth rocker arm) is located in front of the exhaust driven rocker arm 43 on the exhaust rocker shaft 4 and pivotably supported on the exhaust rocker shaft 4. The exhaust drive rocker arm 49 has a configuration symmetrical to the intake-side low-speed drive rocker arm 32.

The exhaust drive rocker arm 49 will be roughly described with the same reference numerals as those for the low-speed drive rocker arm 32. The exhaust drive rocker arm 49 is biased by a bias spring, not shown, in the valve-closing direction through the bias portion 33*a*, to thereby bring the roller 35, which is provided in the right side thereof, into contact with the exhaust cam 7. Extending from the exhaust drive rocker arm 49 in the rear direction is the operation arm portion 36 (third engaging projection). The operation arm portion 36 has the tip end that is bent leftward to have an L-shape, to thereby face the operation window 22 of the cylinder portion 48 of the exhaust driven rocker arm 43. The exhaust drive rocker arm 49 is oscillated along the shape of the exhaust cam 7 while rotating the roller 35. In the base circular zone of the exhaust cam 7, the exhaust drive rocker arm 49 is oscillated in the valve-closing direction to separate the tip end of the operation arm portion 36 from the operation window 22 in the rightward direction as shown by a solid line in FIG. 4. In the lift zone of the exhaust cam 7, the exhaust drive rocker arm 49 is oscillated in the valve-opening direction to insert the tip end of the operation arm portion 36 into the operation window 22 as shown by a chained double-dashed line in FIG. 4.

Descriptions about the valve gear for one cylinder of the suspension cylinder bank have been completed. The other cylinders each have a configuration identical to the aforementioned one.

<Oil Path>

Referring to FIGS. 1 and 2, an oil path 51 for cylinder suspending mode and an oil path 52 for high-speed mode are formed in the intake rocker shaft 3 along the axial direction thereof. The oil paths 51 and 52 each have front and rear ends that are open in front and rear end surfaces of the intake rocker shaft 3, respectively. The front end of the oil path 51 is sealed with a plug 53, and one end of an L-shaped metal pipe 54 is pressed and fixed into the rear end of the oil path 51. The front end of the oil path 52 is connected to an oil control valve (hereinafter referred to as OCV) 55 for high-speed mode via an oil supply path, not shown, formed in the cylinder head 1. The rear end of the oil path 52 is blocked with a plug 56.

In the exhaust rocker shaft 4, an oil path 57 for cylinder suspending mode is formed along the axial direction of the shaft 4. The oil path 57 has front and rear ends that are open in front and rear end surfaces of the exhaust rocker shaft 4, respectively. The front end of the oil path 57 is connected to an OCV 58 for cylinder suspending mode via an oil supply path, not shown, formed in the cylinder head 1. One end of an L-shaped metal pipe 59 is pressed and fixed into the rear end of the oil path 57. The other ends of the intake-side and exhaust-side metal pipes 54 and 59 face each other with a prescribed distance therebetween and interfitted with respective ends of a rubber hose 60 to be connected to each other.

The OCV 55 for high-speed mode and the OCV 58 for cylinder suspending mode receive oil supply from a lubricating oil pump, not shown, provided to the engine, and are switching-controlled by an ECU 61 (control means, and abbreviation for engine control unit) that is mounted on the vehicle, to thereby appropriately supply oil to the oil path 52 for high-speed mode and the oil path 57 for cylinder suspending mode.

As illustrated in FIGS. 2 and 3, communication paths 63 are formed in three places (drawings show only one) of the intake rocker shaft 3 to correspond to the low-speed cylinder portions 16 of the intake driven rocker arms 11 of the cylinders concerned. Each communication path 63 has a lower end communicating with the oil path 51 for cylinder suspending mode and an upper end that is open in the outer circumferential surface of the intake rocker shaft 3 and communicates with the lower cylinder 16*a* of each low-speed cylinder portion 16.

Referring to FIGS. 2 and 5, communication paths 64 are formed in three places (drawings show only one) of the intake rocker shaft 3 to correspond to the high-speed cylinder portions 17 of the intake driven rocker arms 11 of the cylinders concerned. Each communication path 64 has a lower end communicating with the oil path 52 for high-speed mode and an upper end that is open in the outer circumferential surface of the intake rocker shaft 3 and communicates with the cylinder 17*a* of each high-speed cylinder portion 17.

As is clear from FIGS. 2 and 3, communication paths 65 are formed in three places (drawings show only one) of the exhaust rocker shaft 4 to correspond to the cylinder portions 48 of the exhaust driven rocker arms 43 of the associated cylinders. Each communication path 65 has a lower end communicating with the oil path 57 for cylinder suspending mode and an upper end that is open in the outer circumferential surface of the exhaust rocker shaft 4 and communicates with the lower cylinder 16*a* of each cylinder portion 48.

According to the present embodiment, a first switching mechanism for switching the positions of the lower and upper pistons 18*a*, 18*b* of the low-speed cylinder portion 16 of the intake driven rocker arm 11 is constituted by the oil path 51 for cylinder suspending mode, the OCV 58 for cylinder suspending mode, and the communication paths 63, a second switching mechanism for switching the position of the piston 25 of the high-speed cylinder portion 17 of the intake driven rocker arm 11 is constituted by the oil path 52 for high-speed mode, the OCV 55 for high-speed mode, and the communication paths 64, and a third switching mechanism for switching the positions of the lower and upper pistons 18*a*, 18*b* of the cylinder portion 48 of the exhaust driven rocker arm 43 is constituted by the oil path 57 for cylinder suspending mode, the OCV 58 for cylinder suspending mode, and the communication paths 65.

<Non-Suspension Cylinder Bank>

A valve gear of a non-suspension cylinder bank has no cylinder suspending mechanism and has only a switching mechanism for switching between the low-speed mode and the high-speed mode. A concrete configuration of the valve gear of the non-suspension cylinder bank will be described hereinafter. In the intake side, the low-speed cylinder portions 16 of the intake driven rocker arm 11 and the low-speed drive rocker arm 32 are not provided (the high-speed cylinder portions 17 and the high-speed drive rocker arm 38 are maintained). The intake driven rocker arm 11 is oscillated directly by the low-speed cam 6 without the medium of the low-speed drive rocker arm 32, to thereby open and close the intake valve all the time.

In the exhaust side, the cylinder portion 48 of the exhaust driven rocker arm 43 and the exhaust drive rocker arm 49 do not exist. Therefore, the exhaust driven rocker arm 43 is oscillated directly by the exhaust cam 7 without the medium of the exhaust drive rocker arm 49, to thereby open and close the exhaust valve all the time. Since the intake and exhaust driven rocker arms 11 and 43 are constantly oscillated as stated, the suspension cam 8 of the camshaft 2 is not provided, either. Furthermore, the lack of the cylinder suspending mechanism entails the absence of the oil paths 51 and 57 for cylinder suspending mode, which are to be located in the intake and exhaust rocker shafts 3 and 4.

The following description is about an operating state of the valve gear with a cylinder suspending mechanism of the engine, which is configured in the aforementioned manner.

Switching control of the OCVs 55 and 58 is carried out by the ECU 61, based on engine speed Ne. For instance, the cylinder suspending mode is activated in a rotation range where the engine speed Ne is less than a first threshold value Ne1, and an output demand to the engine is adequately low. The low-speed mode is activated in a rotation range where the engine speed Ne falls in the range of from the first threshold value Ne1 to a second threshold value Ne2 (>Ne1), and ordinary engine output is required. The high-speed mode is activated in a rotation range where the engine speed Ne is equal to or more than the second threshold value Ne2, and particularly high engine output is required. Hereinafter, the operating state of the valve gear will be described with respect to each mode.

<Low-Speed Mode>

In the suspension cylinder bank, the ECU 61 switching-controls the OCV 55 for high-speed mode and the OCV 58 for cylinder suspending mode and discontinues the oil supply to the oil path 51 for cylinder suspending mode and the oil path 52 for high-speed mode.

As a result, in the low-speed cylinder portion 16 of the intake driven rocker arm 11 and the cylinder portion 48 of the exhaust driven rocker arm 43, the lower pistons 18*a* and the upper pistons 18*b* are held in the lower positions by a biasing force of the respective compression springs 21, and the outer circumferential surfaces of the upper pistons 18*b* are exposed through the respective operation windows 22, as shown in FIG. 3. As shown in FIG. 5, in the high-speed cylinder portion 17 of the intake driven rocker arm 11, the biasing force of the compression spring 28 holds the piston 25 in the lower position, and the run-off 30 is then exposed through the operation window 29.

During the operation of the engine, the low-speed drive rocker arm 32, the high-speed drive rocker arm 38, and the exhaust drive rocker arm 49 are constantly oscillated along the shapes of the corresponding cams 6, 7 and 9. Along with the oscillation, the tip ends of the operation arm portions 36 and 41 are inserted into and separated from the operation windows 22 and 29 of the driven rocker arms 11 and 43.

The high-speed drive rocker arm 38 independently strikes at the air with the tip end thereof inserted into and separated from the run-off 30 that is exposed through the operation window 29 of the high-speed cylinder portion 17. The high-speed drive rocker arm 38 does not oscillate the driven rocker arms 11 and 43 as the after-mentioned low-speed drive rocker arm 32 and exhaust drive rocker arm 49 do.

The low-speed drive rocker arm 32 and the exhaust drive rocker arm 49 press the outer circumferential surfaces of the upper pistons 18*b* exposed through the operation windows 22 of the low-speed cylinder portion 16 and the cylinder portion 48 when being oscillated in the valve-opening direction. By so doing, the drive rocker arms 32 and 49 oscillate the corresponding driven rocker arms 11 and 43 in the valve-opening direction, to thereby open the intake and exhaust valves. When the low-speed drive rocker arm 32 and the exhaust drive rocker arm 49 are oscillated in the valve-closing direction, the corresponding driven rocker arms 11 and 43 receive the biasing force of the valve springs, which is produced along with the closing of the intake and exhaust valves, and are then oscillated in the valve-closing direction.

Consequently, the intake driven rocker arm 11 is oscillated with the low-speed drive rocker arm 32 to open and close the intake valves along the shape of the low-speed cam. The exhaust driven rocker arm 43 is oscillated with the exhaust drive rocker arm 49 to open and close the exhaust valves along the shape of the exhaust cam.

In the non-suspension cylinder bank, since the ECU 61 discontinues the oil supply to the oil path 52 for high-speed mode from the OCV 55 for high-speed mode, the high-speed drive rocker arm 38 strikes at the air as is the case with the suspension cylinder bank. Thus, the intake valves are driven to open and close along the shape of the low-speed cam 6, and the exhaust valves along the shape of the exhaust cam 7. As a consequence, in the low-speed mode, the engine output required within the ordinary rotation range is realized by using the low-speed cam 6 and the exhaust cam 7.

<Cylinder Suspending Mode>

While stopping the oil supply to the oil path 52 for high-speed mode in the suspension cylinder bank and the non-suspension cylinder bank, the ECU 61 supplies oil from the OCV 58 for cylinder suspending mode in the suspension cylinder bank.

The oil running from the OCV 58 flows through the oil path 57 of the exhaust rocker shaft 4 from the front side to the rear side to be supplied into the lower cylinder 16*a* of the exhaust driven rocker arm 43 via each communication path 65. The oil subsequently passes through the metal pipes 54 and 59 and the hose 60, and then flows through the oil path 51 of the intake rocker shaft 3 from the rear side to the front side. Eventually the oil is supplied into the lower cylinder 16*a* of the intake driven rocker arm 11 via each communication path 63.

In the lower cylinders 16*a* and the upper cylinders 16*b* of the intake driven rocker arm 11 and the exhaust driven rocker arm 43, the lower pistons 18*a* and the upper pistons 18*b* slide upward in response to hydraulic pressure of the supplied oil, resisting the compression spring 21, to be switched to the respective upper positions. This movement exposes the run-offs 23 of the lower pistons 18*a* through the respective operation windows 22. Therefore, the low-speed drive rocker arm 32 and the exhaust drive rocker arm 49 independently strike at the air with the respective tip ends inserted into and separated from the run-offs 23 exposed through the operation windows 22 of the corresponding driven rocker arms 11 and 43, to thereby halt the oscillating operation with respect to the driven rocker arms 11 and 43.

Since the high-speed drive rocker arm 38 also strikes at the air, in each cylinder of the suspension cylinder bank, the intake and exhaust valves are kept closed due to the biasing force of the valve springs, and the intake driven rocker arm 11 and the exhaust driven rocker arm 43 are held at valve-closing positions while the sliding-contact portions 15*a* and 47*a* of the cam-side arms 15 and 47 are in contact with the suspension cam 8.

In the non-suspension cylinder bank, the operation of each cylinder is continued as in the low-speed mode, and the vehicle is operated by torque generated in the non-suspension cylinder bank. At the same time, the suspension of each cylinder in the suspension cylinder bank makes it possible to cut back on fuel consumption.

<High-Speed Mode>

In the suspension cylinder bank, the ECU 61 discontinues the oil supply to the oil path 51 for cylinder suspending mode from the OCV 58 for cylinder suspending mode, and on the other hand supplies oil to the oil path 52 for high-speed mode from the OCV 55 for high-speed mode.

In consequence, as in the low-speed mode, the outer circumferential surfaces of the upper pistons 18*b* are exposed through the operation windows 22 in the low-speed cylinder portion 16 of the intake driven rocker arm 11 and the cylinder portion 48 of the exhaust driven rocker arm 43.

The oil flowing in the oil path 52 is supplied through the communication path 64 into the cylinder 17*a* of the high-speed cylinder portion 17 in the intake driven rocker arm 11 of each cylinder. In the cylinder 17*a*, the piston 25 slides upward in response to the hydraulic pressure of the supplied oil, resisting the compression spring 28, to be switched to the upper position. The outer circumferential surface of the piston 25 is then exposed through the operation window 29.

As a result, in the exhaust side, the exhaust driven rocker arm 43 is oscillated with the exhaust drive rocker arm 49 along the shape of the exhaust cam 7, and the exhaust valve is driven to be open and close along the shape of the exhaust cam 7 as in the low-speed mode.

In the intake side, the pistons 18*b* and 25 of the low-cylinder portion 16 and the high-speed cylinder portion 17 are both exposed, and therefore can be pressed by the corresponding drive rocker arms 32 and 38. However, only the high-speed drive rocker arm 38 actually performs the pressing operation, and the low-speed drive rocker arm 32 strikes the air. This is because the high-speed cam 9 has a wider lift zone (or operation angle) and a greater lift amount, compared to the low-speed cam 6. In short, the intake valves are driven to be open and close along the shape of the high-speed cam 9 in the high-speed mode.

In the non-suspension cylinder bank as well as the suspension cylinder bank, oil is supplied to the oil path 52, and the intake valves are driven to be open and close along the shape of the high-speed cam 9. Consequently, in the high-speed mode, high engine output required in the high rotation range is realized by extending an opening period of the intake valves or by increasing the lift amount thereof, compared to the low-speed mode.

The valve gear with a cylinder suspending mechanism of the engine according to the present embodiment operates as stated above. According to the present embodiment, the lower piston 18*a* of the low-speed cylinder portion 16 of the low-speed driven rocker arm 11 and the lower piston 18*a* of the cylinder portion 48 of the exhaust driven rocker arm 43 are made smaller in diameter than the piston 25 of the high-speed cylinder portion 17 of the low-speed driven rocker arm 11, as described above. In the following, functions and advantages achieved by such configuration will be explained in detail.

The oil used to switch the positions of the pistons 18*a*, 18*b*, 25 of the intake and exhaust driven rocker arms 11, 43 is supplied from the oil pump of the engine. In a low rotation range of the engine where the rotation speed of the pump decreases, it cannot be expected that an adequate amount of oil is discharged from the pump. Therefore, the piston position is switched in the low-speed cylinder portion 16 of the intake driven rocker arm 11 and the cylinder portion 48 of the exhaust driven rocker arm 43 utilizing an insufficient amount of discharged oil in a low rotation range (less than the first threshold value Ne1), although the position of the piston 25 is quickly switched in the high-speed cylinder portion 17 of the intake driven rocker arm 11 utilizing an adequate amount of discharged oil in a high rotation range (higher than the second threshold value Ne2).

To be noted, in each of the cylinder portions 16 and 48, it is the lower piston 18*a* that actually receives the oil pressure. Since these lower pistons 18*a* are smaller in diameter than the piston 25 of the high-speed cylinder portion 17, the lower pistons 18*a* are quickly slidingly moved to the upper positions, even if the oil supply to the lower cylinder 16*a* is slow in speed due to the insufficient amount of oil discharged from the oil pump. As a result, the switching from the low-speed mode to the cylinder suspending mode can be completed with a satisfactory response, making it possible to improve drivability.

In this embodiment, the upper pistons 18*b* of the low-speed cylinder portion 16 and the cylinder portion 48 are arranged to be pressed by the operation arm portions 36 of the low-speed drive rocker arm 32 and the exhaust drive rocker arm 49 when they are at the lower positions. Alternatively, the upper pistons 18*b* may be arranged to be pressed by the operation arm portions 36 when they are at the upper positions. In this case, prompt switching from the cylinder suspending mode to the low-speed mode can be realized by making the lower pistons 18*a* smaller in diameter. This is advantageous in that functions and advantages of preventing a delay in the mode switching from the cylinder suspending mode to the low-speed mode can be attained in view of the fact that, if a delay is caused in the mode switching performed in response to the driver's request for acceleration which is made in the form of depression of the accelerator or the like, bad acceleration or other bad impression on the driver is resulted.

As for the upper piston 18*b*, a certain diameter must be ensured in consideration of the following factors. First of all, in the low-speed cylinder portion 16 and the cylinder portion 48 having the lower pistons 18*a* which are small in diameter, there is no room to dispose the compression spring 28 offset, unlike in the high-speed cylinder portion 17 having the piston 25 that is large in diameter. Therefore, the compression spring 21 is inevitably disposed in an upper side of the upper piston 18*b*. In order to urge the upper piston 18*b* downward, the diameter or length of the compression spring 21 must be increased to some extent. However, when the spring length is increased, the cylinder portions 16, 48 largely project upward from the rotation centers of the driven rocker arms 11, 43, and as a result, not only the inertia mass of the valve gear increases but also the engine height increases. To obviate this, the technique of increasing the spring diameter is adopted. To conform to the increased spring diameter, it is necessary to enlarge the diameter of the upper piston 18*b*.

The low-speed and exhaust drive rocker arms 32, 49 are each required to have a predetermined pressing stroke in order to open the intake or exhaust valves through the medium of the intake or exhaust driven rocker arm 11 or 43. At the time of cylinder suspension, the run-off 23 of the lower piston 18*a* of each driven rocker arm 11 or 43 is required to have a depth (left-to-right size in FIG. 3) large enough to be equivalent to the pressing stroke. Furthermore, the lower piston 18*a* must have an adequate wall thickness after being formed with the run-off 23. In order to satisfy the requirements as to the pressing stroke, the depth of the run-off 23, and the wall thickness, it is necessary to arrange the drive rocker arms 32, 42 such that they are brought into contact with the upper pistons 18*b* more on this side during the oscillatory motion in the valve-closing direction. This inevitably requires making the upper pistons 18*b* larger in diameter.

According to this embodiment where the piston of each of the low-speed cylinder portion 16 and the cylinder portion 48 is vertically split into two, one is the lower piston 18*a* and the other is the upper piston 18*b*, it is possible to enlarge the diameter of the upper piston 18*b* without being restricted by the diameter of the lower piston 18*a* which is to be made smaller enough to realize a quick switching of the piston positions.

More specifically, in this embodiment, the piston of each of the low-speed cylinder portion 16 of the intake driven rocker arm 11 and the cylinder portion 48 of the exhaust driven rocker arm 43 is vertically split into two, the lower and upper pistons 18*a*, 18*b*, and in addition, the upper piston 18*b* is made of a material that is higher in rigidity and wear resistance than that for the lower piston 18*a*. In the following, functions and advantages of such configuration will be described in detail.

As compared to the lower pistons 18*a* which mainly receive the oil pressure alone, the upper pistons 18*b* are pressed by the operation arm portions 36 of the low-speed and exhaust drive rocker arms 32, 49 in order to cause the entire driven rocker arms 11, 43 to be oscillated against their inertia masses. Thus, the upper pistons 18*b* are required to have higher rigidity. Also, the upper pistons 18*b* are required to have higher wear resistance since they collide with the tip ends of the operation arm portions 36 each time the operation arm portions 36 are oscillated.

In the case of a piston having integrally formed lower and upper pistons 18*a* and 18*b*, the entire piston must be made of a high-priced material (for example, carburized material) in order to satisfy the characteristic demanded to the upper piston 18*b*. According to this embodiment, a high-priced material must be used only for the upper piston 18*b*, and a lower-priced material (for example, uncarburized material) can be used for the lower piston 18*a*. This makes it possible to prevent fracture of the upper piston 18*b* or other troubles, thereby improving the reliability of the valve gear, and further possible to reduce the fabrication cost of the piston of each of the driven rocker arms 11 and 43, and by extension, the fabrication cost of the entire valve gear.

Furthermore, the configuration having the vertically split into two pistons 18*a* and 18*b* also has a merit of capable of smoothly sliding the pistons 18*a* and 18*b*. More specifically, if these pistons with different diameters are integrally formed, respective cylinders 16*a* and 16*b* individually corresponding to the piston diameters must be formed in such a manner that their axes coincide with each other. This makes it extremely difficult to machine the cylinders, causing a difficulty in maintaining the intended tolerance. As a result, the piston clearance tends to increase, possibly causing oil leakage in the lower piston 18*a* and sliding motion failure in the upper piston 18*b* due to scuffing. According to this embodiment where the piston is split into the upper and lower pistons 18*a* and 18*b*, the cylinder can be easily machined since it is enough to form each of the cylinders 16*a*, 16*b* so as to conform to the corresponding piston diameter, without the need of aligning the axes of the cylinders 16*a*, 16*b*. Thus, the intended piston clearance can be achieved, and therefore, the aforesaid drawbacks can be prevented, whereby a smooth piston sliding motion can be realized, contributing to improve the reliability of the valve gear.

Next, a second embodiment will be explained, in which this invention is embodied in a different valve gear of an engine.

The valve gear of this embodiment has a construction in which the cylinder suspending mechanism is removed from the valve gear of the first embodiment. In other words, it only comprises a switching mechanism for switching the low-speed mode and the high-speed mode. In the following, differences between this embodiment and the first embodiment will be mainly described based on the configuration of the suspension cylinder bank according to the first embodiment. Common parts denoted by like numerals will be briefly explained.

Figure 9:
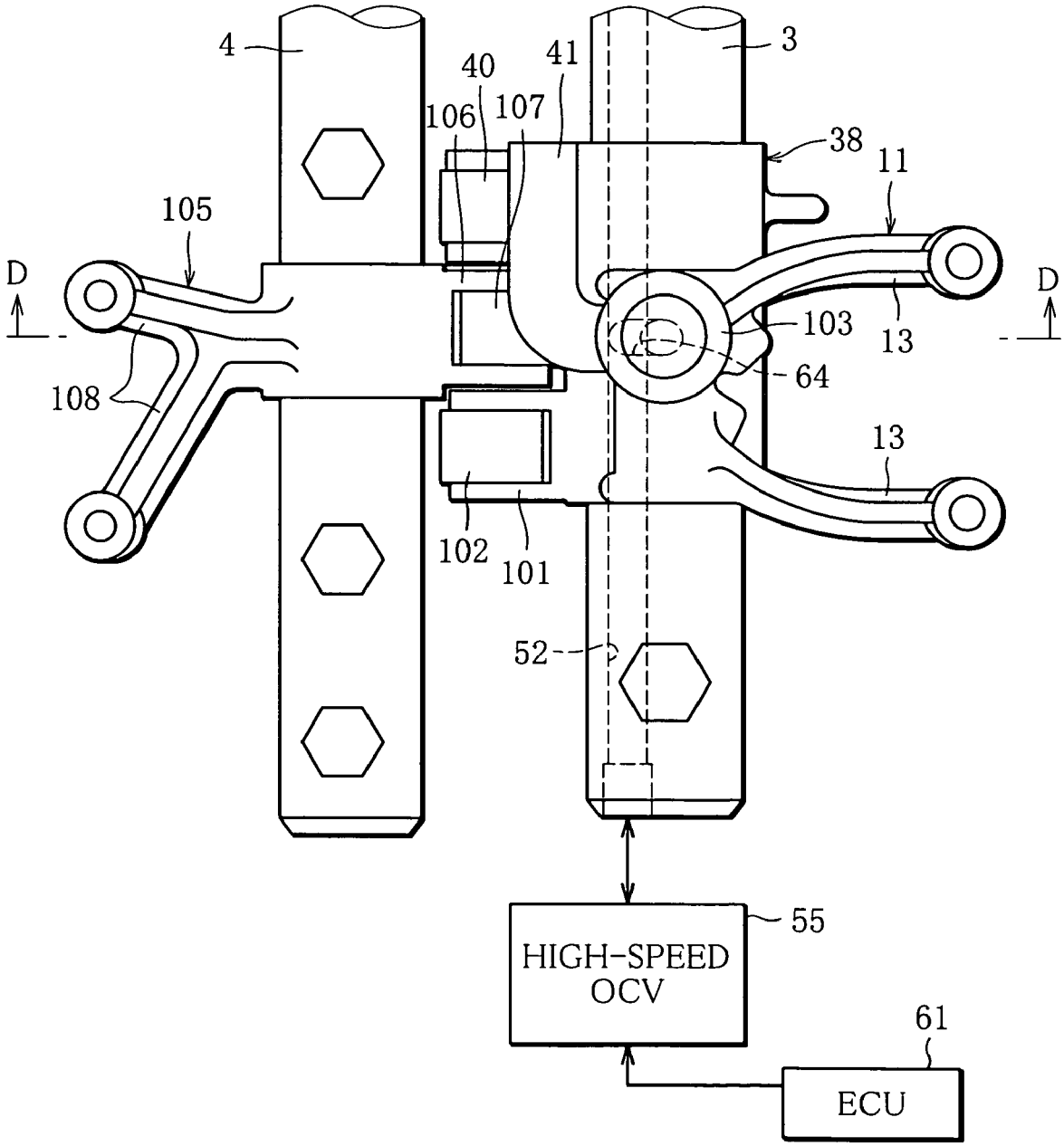
FIG. 9 is an enlarged partial plan view showing details of the valve gear for one cylinder according to a second embodiment.
Figure 10:
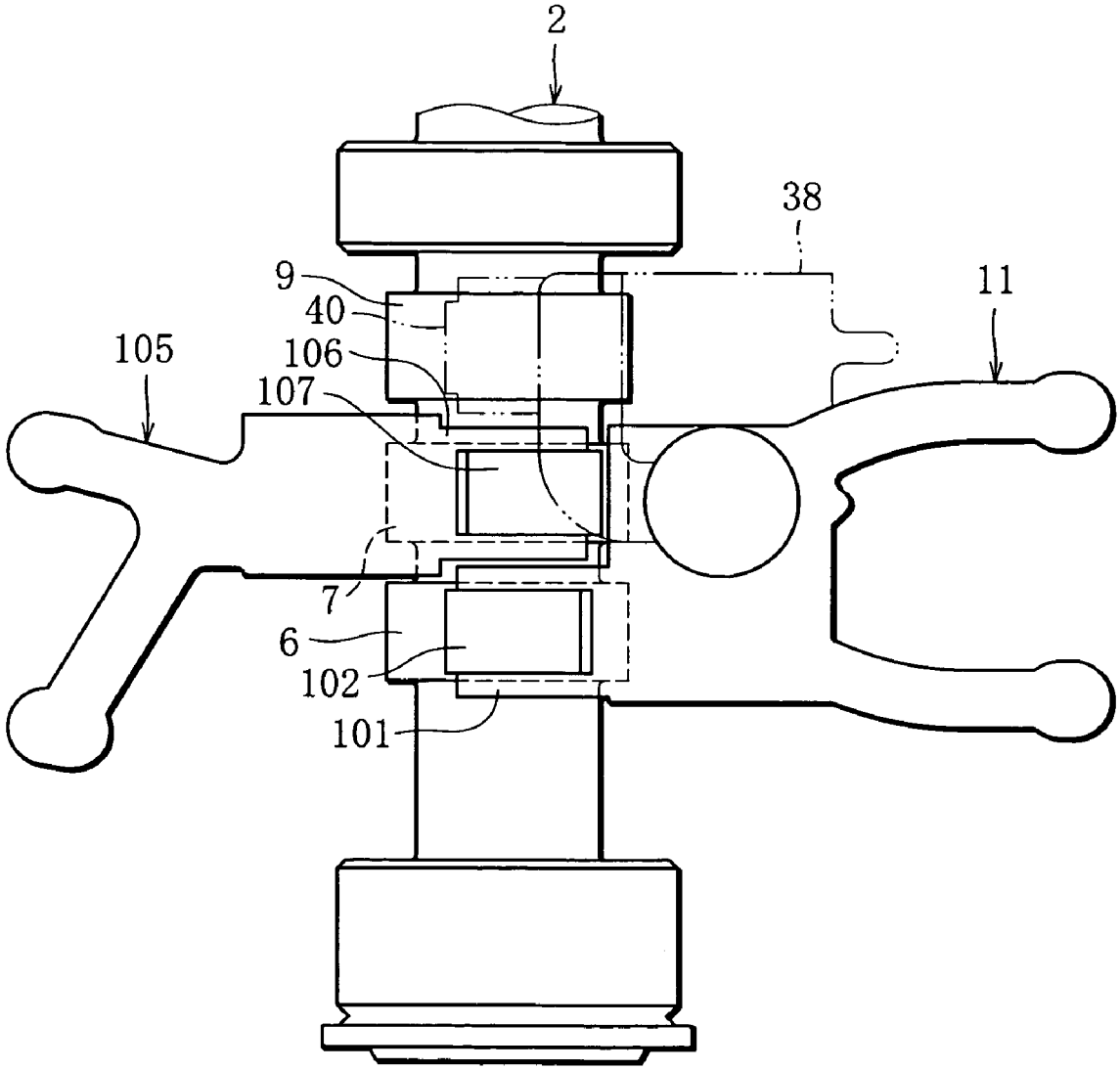
FIG. 10 is an enlarged partial plan view showing the positional relation of drive rocker arms and driven rocker arms with respect to the cams.
Figure 11:
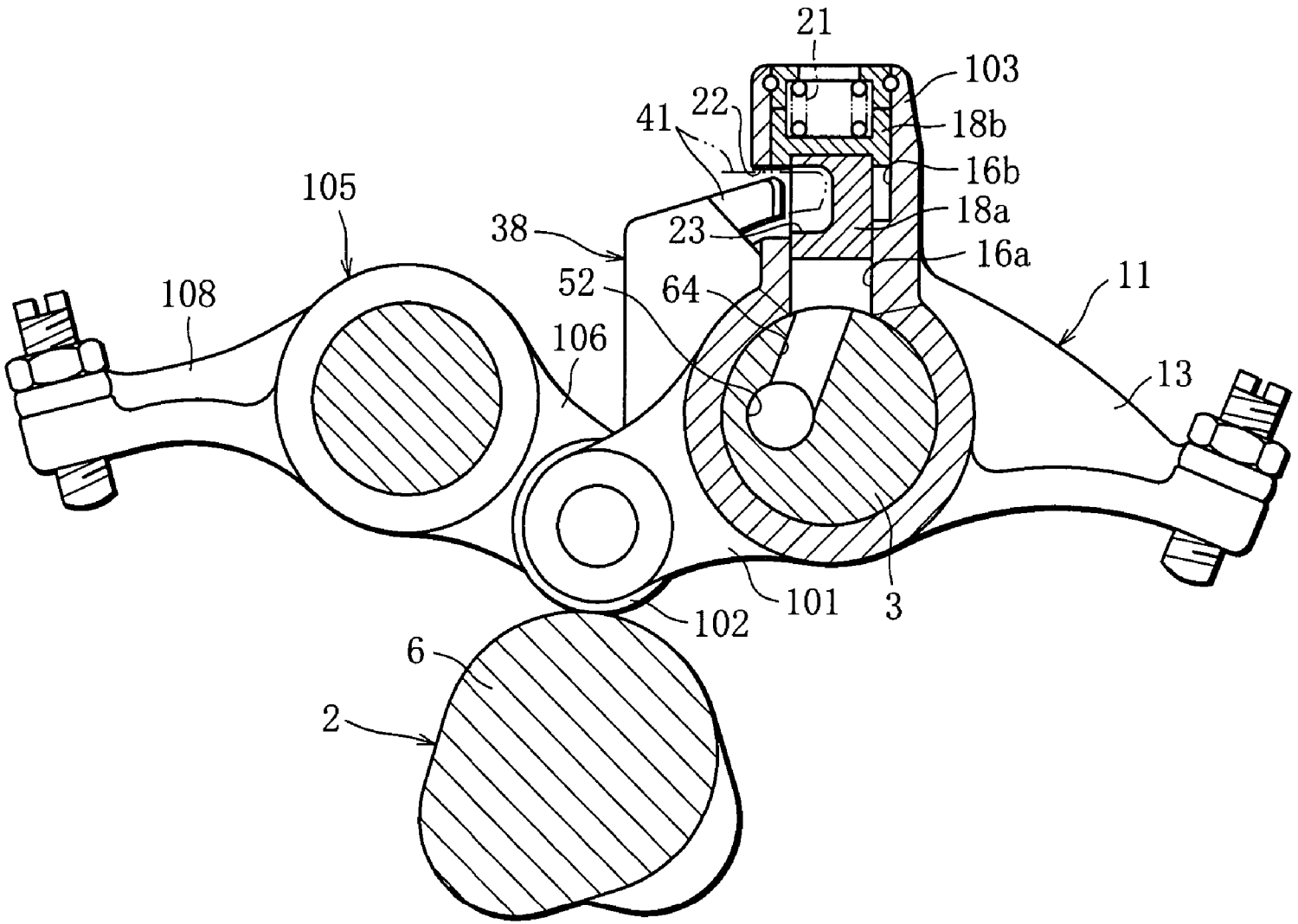
FIG. 11 is a cross-sectional view taken along line D—D of FIG. 9, showing an operating state of a low-speed cam.

FIG. 9 is an enlarged partial plan view showing details of the valve gear for one cylinder, FIG. 10 is an enlarged partial plan view showing the positional relation of drive rocker arms and driven rocker arms with respect to the cams, and FIG. 11 is a cross-sectional view taken along line D—D of FIG. 9 showing a state where the low-speed cam is in operation.

<Intake-Side Valve Gear>

The intake driven rocker arm 11 (sixth rocker arm) supported by the intake rocker shaft 3 is provided with a cam-side arm portion 101 extending leftward from the rocker arm 11. A roller 102 provided in a tip end of the cam-side arm portion 101 is in contact with the low-speed cam 6 (fourth cam) formed on the cam shaft 2. The intake driven rocker arm 11 is oscillated along the shape of the low-speed cam 6, while rolling the roller 102 on the low-speed cam 6, whereby the intake valves, not shown, are caused to open and close through the medium of the valve-side arm portions 13.

The intake driven rocker arm 11 is provided with a high-speed cylinder portion 103 which has the same configuration as that of the low-speed cylinder portion 16 of the first embodiment. More specifically, the lower piston 18*a* (second portion of a fourth piston) is disposed for vertical sliding motion in the lower cylinder 16*a* (half of a fourth cylinder) of the high-speed cylinder portion 103, and the upper piston 18*b* (first portion of the forth piston) is disposed for vertical sliding motion in the upper cylinder 16*b* (another half of the fourth cylinder) of the high-speed cylinder portion 103. The lower and upper pistons 18*a*, 18*b* are always urged downward by the compression spring 21. When the piston is at the lower position where the lower face of the lower piston 18*a* is in contact with the outer circumferential face of the intake rocker shaft 3, the run-off 23 of the lower piston 18*a* is exposed leftward through the operation window 22. When the piston is slidingly moved upward, resisting the compression spring 22, from the lower position to the upper position, the outer circumferential face of the upper piston 18*b* is exposed leftward through the operation window 22.

Also in this embodiment, the upper piston 18*b* is larger in diameter than the lower piston 18*a* and is made of a material higher in rigidity and wear resistance than that for the lower piston 18*a*.

On the rear side of the intake driven rocker arm 11, there is the high-speed drive rocker arm 38 (seventh rocker arm) which is pivotally supported by the intake rocker shaft 3. The high-speed drive rocker arm 38 is urged by a biasing spring, not shown, in the valve-closing direction and causes a roller 40 provided on the left side thereof to be in contact with the high-speed cam 9 (fifth cam) on the cam shaft 2. The high-speed drive rocker arm 38 is oscillated along the shape of the high-speed cam 9 while rotating the roller 40 on the high-speed cam 9. With the oscillatory motion, the operation arm portion 41 (fourth engaging projection) is inserted into and separated from the operation window 22 of the high-speed cylinder portion 103.

<Exhaust-Side Valve Gear>

The exhaust rocker arm 105 supported by the exhaust rocker shaft 4 is provided with a cam-side arm portion 106 extending rightward from the exhaust rocker arm 105. A roller 107 provided at a tip end of the cam-side arm portion 106 is in contact with the exhaust cam 7 on the cam shaft 2. The exhaust rocker arm 105 is oscillated along the shape of the exhaust cam 7 while rolling the roller 107 on the exhaust cam 7, whereby the exhaust valves, not shown, are opened and closed through the medium of valve-side arm portions 108.

<Oil Path>

The intake rocker shaft 3 is formed with the oil path 52 for high-speed mode which is in communication with the high-speed cylinder portion 103 of the intake driven rocker arm 11 of each cylinder through the communication paths 64. The oil path 52 is connected at its front end with the OCV 55 for high-speed mode that is switching-controlled by the ECU 61 (control means).

In this embodiment, a fourth switching mechanism for switching the positions of the lower and upper positions 18*a*, 18*b* of the high-speed cylinder portion 103 of the intake driven rocker arm 11 is constituted by the oil path 52 for high-speed mode, the OCV 55 for high-speed mode, and the communication paths 64.

Next, the operation of the valve gears of the engine constructed as mentioned above will be explained.

<Low-Speed Mode>

For both the suspension cylinder bank and the non-suspension cylinder bank, the ECU 61 supplies oil from the OCV 55 for high-speed mode to the oil path 52 for high-speed mode. As a result, as shown in FIG. 11, in the high-speed cylinder portion 103 of the intake driven rocker arm 11, the lower and upper pistons 18*a*, 18*b* are maintained at the upper positions, so that the run-off 23 is exposed through the operation window 22. Thus, the high-speed rocker arm 38 runs idle, while causing its tip end to move into and out of the run-off 23. Thus, the intake driven rocker arm 11 is oscillated by the low-speed cam 6 and causes the intake valves to open and close along the shape of the low-speed cam 6, whereas the exhaust rocker arm 105 is driven by the exhaust cam 7.

<High-Speed Mode>

For both the suspension cylinder bank and the non-suspension cylinder bank, the ECU 61 stops the oil supply from the OCV 55 for high-speed mode to the oil path 52 for high-speed mode. As a result, the lower and upper pistons 18*a*, 18*b* in the high-speed cylinder portion 103 of the intake driven rocker arm 11 are changed to the lower positions, so that the high-speed drive rocker arm 38 operates to press the outer circumferential face of the upper piston 18*b* exposed through the operation window 22. Thus, the intake driven rocker arm 11 is oscillated together with the high-speed drive rocker arm 38, whereby the intake valves are opened and closed along the shape of the high-speed cam 9, whereas the exhaust rocker arm 105 is driven by the exhaust cam 7 as in the case of the low-speed mode.

The functions and advantages attained by the above configuration are similar to those of the first embodiment, and hence detailed explanations are omitted herein. In brief, a high-priced material is used only for the upper piston 18*b* of the high-speed cylinder portion 103 that is required to have higher rigidity and wear resistance, whereas a low-priced material is used for the lower piston 18*a*. Thus, troubles such as breakage of the upper piston 18*b* can be prevented, whereby the reliability of the valve gear can be improved, and in addition, the fabrication cost of the piston of the intake driven rocker arm 11, and by extension, the fabrication cost of the entire valve gear can be reduced.

Furthermore, since the lower piston 18*a* is made smaller in diameter than the upper piston 18*b*, the switching from the high-speed mode to the low-speed mode can be completed with a satisfactory response. At the same time, since the upper piston 18*b* is made larger in diameter, the high-speed drive rocker arm 38 is enabled to press the upper piston 18*b* with an adequate pressing stroke, thus ensuring the switching from the low-speed mode to the high-speed mode.

Although the explanation of the embodiment has been completed, the form of the present invention is not limited to the above embodiment. For instance, the invention is applied to the V-six cylinder gasoline engine having four valves per cylinder in the above embodiment. As long as the engine is one having a valve gear, however, the engine does not have to be a V-six cylinder gasoline engine in terms of category and type. On the contrary, the invention may be applied to for example a diesel engine or an in-line four-cylinder engine having two valves per cylinder.

In the embodiment, the cylinder suspending mechanism is provided in the cylinder suspending bank not only on the intake side but also on the exhaust side, thereby maintaining the exhaust valves closed during the cylinder suspension. However, the cylinder suspending mechanism on the exhaust side may be omitted, so that the exhaust driven rocker arm 43 is directly oscillated by the exhaust cam 7, for instance.

In the embodiment, the piston of each of the low-speed cylinder portion 16 and the cylinder portion 48 is divided into two, the lower and upper pistons 18*a* and 18*b*, the lower piston is made smaller in diameter than the upper piston, and both the pistons 18*a*, 18*b* are made of different materials. However, such configuration is not inevitably necessary. For example, the lower and upper pistons 18*a*, 18*b* may be made of the same material, and these pistons 18*a*, 18*b* may integrally be formed.

In the first embodiment, the valve gear is configured capable of making the switching between the low-speed mode, the high-speed mode, and the cylinder suspending mode. However, the high-speed cylinder portion 17 of the intake driven rocker arm 11 and the high-speed drive rocker arm 38 may be omitted, or the cylinder portion 48 of the exhaust driven rocker arm 43 and the exhaust drive rocker arm 49 may be omitted, for example.

What is claimed is:

1. A valve gear with a cylinder suspending mechanism of an internal combustion engine, comprising:

a first rocker arm having a tip end connected to either one of an intake valve and an exhaust valve and pivotably supported on a first rocker shaft;

a second rocker arm located at one side of said first rocker arm, pivotably supported on said first rocker shaft, and driven by a first cam for low speed;

a third rocker arm located at the other side of said first rocker arm, pivotably supported on said first rocker shaft, and driven by a second cam for high speed;

a first piston slidably fitted into a first cylinder formed in said first rocker arm;

a second piston slidably fitted into a second cylinder formed in said first rocker arm;

a first engaging projection extending from said second rocker arm and formed to be engageable with said first piston;

a second engaging projection extending from said third rocker arm and formed to be engageable with said second piston;

first and second switching mechanisms for applying oil pressure to said first and second pistons, to thereby switch these pistons between an engaging position and a non-engaging position with respect to said first and second engaging projections, respectively; and control means for controlling the switching of said first and second switching mechanisms, wherein said first piston is made smaller in diameter than said second piston.

2. The valve gear with a cylinder suspending mechanism of an internal combustion engine according to claim 1, wherein said first piston is vertically divided into two, one is a first portion adapted to be engaged with said first engaging projection and the other is a second portion adapted not to be engaged with said first engaging projection.

3. The valve gear with a cylinder suspending mechanism of an internal combustion engine according to claim 2, wherein said second portion of said first piston is slidably received in said first cylinder and made smaller in diameter than said first portion.

4. The valve gear with a cylinder suspending mechanism of an internal combustion engine according to claim 3, wherein said second portion is made of a material that is lower in rigidity than a material of which said first portion is made.

5. The valve gear with a cylinder suspending mechanism of an internal combustion engine according to claim 3, wherein said control means controls the switching of said first and second switching mechanisms so as to activate any one of a first mode in which said first rocker arm is driven by said first cam, a second mode in which said first rocker arm is driven by said second cam, and a third mode in which said first rocker arm is inoperative.

6. A valve gear with a cylinder suspending mechanism of an internal combustion engine, comprising:

a first rocker arm having a tip end connected to either one of an intake valve and an exhaust valve and pivotably supported on a first rocker shaft;

a second rocker arm located at one side of said first rocker arm, pivotably supported on said first rocker shaft, and driven by a first cam for low speed;

a third rocker arm located at the other side of said first rocker arm, pivotably supported on said first rocker shaft, and driven by a second cam for high speed;

a fourth rocker arm having a tip end connected to the other one of the intake valve and the exhaust valve and pivotably supported on a second rocker shaft that is disposed in parallel to said first rocker shaft;

a fifth rocker arm pivotably supported on said second rocker shaft and driven by a third cam;

a first piston slidably fitted into a first cylinder formed in said first rocker arm;

a second piston slidably fitted into a second cylinder formed in said first rocker arm;

a third piston slidably fitted into a third cylinder formed in said fourth rocker arm;

a first engaging projection extending from said second rocker arm and formed to be engageable with said first piston;

a second engaging projection extending from said third rocker arm and formed to be engageable with said second piston;

a third engaging projection extending from said fifth rocker arm and formed to be engageable with said third piston;

first, second, and third switching mechanisms for applying oil pressure to said first, second, and third pistons, to thereby switch these pistons between an engaging position and a non-engaging position with respect to said first, second, and third engaging projections, respectively; and control means for controlling the switching of said first, second, and third switching mechanisms, wherein each of said first and third pistons is made smaller in diameter than said second piston.

7. The valve gear with a cylinder suspending mechanism of an internal combustion engine according to claim 6, wherein each of said first and third pistons is vertically divided into two, one is a first portion adapted to be engaged with a corresponding one of said first and third engaging projections and the other is a second portion adapted not to be engaged with a corresponding one of said first and third engaging projections.

8. The valve gear with a cylinder suspending mechanism of an internal combustion engine according to claim 7, wherein said second portion is made of a material that is lower in rigidity than a material of which said first portion is made.

9. The valve gear with a cylinder suspending mechanism of an internal combustion engine according to claim 7, wherein said second portion of each of said first and third pistons is slidably received in a corresponding one of said first and third cylinders and made smaller in diameter than said first portion.

10. The valve gear with a cylinder suspending mechanism of an internal combustion engine according to claim 6, wherein said control means controls the switching of said first, second, and third switching mechanisms so as to activate any one of a first mode in which said first rocker arm is driven by said first cam, and said fourth rocker arm by said third cam, a second mode in which said first rocker arm is driven by said second cam, and a third mode in which said first and fourth rocker arms are inoperative.

11. A valve gear of an internal combustion engine, comprising:

a sixth rocker arm having a tip end connected to either one of an intake valve and an exhaust valve, pivotably supported on a rocker shaft, and driven by a fourth cam;

a seventh rocker arm located adjacent to said sixth rocker arm, pivotably supported on said rocker shaft, and driven by a fifth cam having a cam shape different from that of said fourth cam;

a fourth piston slidably fitted into a fourth cylinder formed in either one of said sixth and seventh rocker arms;

a fourth engaging projection extending from the other of said sixth and seventh rocker arms and formed to be engageable with said fourth piston;

fourth switching mechanisms for switching said fourth piston between an engaging position and a non-engaging position with respect to said fourth engaging projection; and control means for controlling the switching of said fourth switching mechanism, wherein said fourth piston is vertically divided into two, one is a first portion adapted to be engaged with said fourth engaging projection and the other is a second portion adapted not to be engaged with said fourth engaging projection.

12. The valve gear of an internal combustion engine according to claim 11, wherein said second portion is made of a material lower in rigidity than a material of which said first portion is made.

13. The valve gear an internal combustion engine according to claim 12, wherein said second portion is slidably received in said corresponding cylinder and made smaller in diameter than said first portion.

* * * * *